United States Patent [19]

Schweitzer

[11] Patent Number: 4,597,198

[45] Date of Patent: Jul. 1, 1986

[54] ORNAMENTAL ATTACHMENT FOR FOOTWEAR AND THE LIKE

[76] Inventor: David W. Schweitzer, 409 Shenipsit Lake Rd., Tolland, Conn. 06084

[21] Appl. No.: 579,185

[22] Filed: Feb. 10, 1984

[51] Int. Cl.[4] ..... A43B 3/24; A43B 23/24

[52] U.S. Cl. ..... 36/100; 36/136; 2/245

[58] Field of Search ..... 2/245; 36/136, 132, 36/112, 100; 24/117, 118, 119

[56] References Cited

U.S. PATENT DOCUMENTS

| | | | |
|---|---|---|---|
| 743,924 | 11/1903 | Pratt . | |
| 1,344,998 | 6/1920 | Fay | 2/245 |
| 1,834,401 | 12/1931 | Hoppe et al. | 2/245 |
| 2,095,989 | 10/1937 | Hermson . | |
| 2,662,677 | 12/1953 | Perry . | |
| 2,801,477 | 8/1957 | Adams et al. . | |
| 4,254,566 | 3/1981 | Haskell | 40/2 E |
| 4,327,512 | 5/1982 | Oliver | 40/2 E |
| 4,372,060 | 2/1983 | Adamik | 36/54 |
| 4,428,101 | 1/1984 | Harkavy | 24/119 X |
| 4,536,975 | 8/1985 | Harrell | 36/136 |

FOREIGN PATENT DOCUMENTS

| | | | |
|---|---|---|---|
| 301265 | 11/1928 | United Kingdom | 2/245 |
| 2021383 | 12/1979 | United Kingdom | 36/132 |

*Primary Examiner*—Henry S. Jaudon
*Assistant Examiner*—T. Graveline

[57] ABSTRACT

An ornamental attachment for mounting on lacing-type footwear has a support member extends under at least a portion of the lace longitudinally along the lacing opening of the article of footwear and face member having a display surface thereon extends over at least a portion of the lace. The ends of the support member are secured to the face member to provide a transverse passage through which the lace crosses. Various types of ornamental attachment members can be utilized including decorative embroidered patches and removable decals.

9 Claims, 5 Drawing Figures

ORNAMENTAL ATTACHMENT FOR FOOTWEAR AND THE LIKE

BACKGROUND OF THE INVENTION

The present invention relates to an attachment for footwear and the like, and more particularly to an ornamental attachment engaged by the shoelace and adapted to display a decorative emblem thereon.

Recently, it has become increasingly popular, especially among children, to wear and display insignias, cartoon characters, words and phrases on shirts, jackets, hats and other articles of clothing. This popularity has spurred the growth of a substantial industry supplying such ornamental items.

It has been previously proposed in U.S. Pat. No. 2,801,477 to provide ornamental attachments for use with articles of footwear. However, the article of footwear must be specially designed to include transparent pockets on its side walls to receive a decorative insert.

U.S. Pat. No. 743,924 proposes an ornamental bow attached to an article of footwear utilizing the lace thereon and a specially designed metallic body. The metallic body is used to secure the lacing without the necessity of tying the lace. Such a device would interfere with the normal tying process of the lace and does not facilitate the use of large ornament designs to be attached thereto.

It is an object of the present invention to provide a novel ornamental attachment for engagement with the shoelace of an article of footwear.

It is also an object to provide such an attachment which does not interfere with the normal tying and untying of the lace of the shoe and permitting the display of different emblems and other decalcomania.

Another object is to provide such an attachment which can be readily coupled to a lacing shoe without modification and which utilizes the existing lace and is readily removable or interchangeable.

A further object is to provide such an attachment which may be readily and economically fabricated and which exhibits reasonable long life.

SUMMARY OF THE INVENTION

It has now been found that the foregoing and related objects can be readily attained in a combination with an article of footwear having an upper with opposed flaps having cooperating apertures in opposed edges thereof and a lace extending through the cooperating apertures, an ornamental attachment engaged with the lace and overlying a portion of the shoe, the attachment including a face member overlying a portion of the lace and a support member attached at its ends to the face member to define a passage between the ends extending generally perpendicularly to the direction of the opposed flaps, the lace extending through the passage as the lace is crisscrossed between at least some of the apertures.

Ideally, the cooperating apertures of the article of footwear are at least four pairs of apertures spaced uniformly along the opposed flaps and through which the lace extends, at least the portions of the lace extending between the upper pair of the at least four apertures and the next adjacent pair being disposed outwardly of the passage. The face member may extend over the lower three pairs of the at least four pairs of opposed apertures in the opposed flaps.

Desirably, the lace extends between the lowermost pair of apertures and through the passage then crisscrosses within the interior of the shoe to the adjacent pair of apertures outwardly of the passage thereinafter the lace crisscrosses to the next adjacent pair of apertures and through the passage to secure. The support member is of lesser width than the spacing between the opposed apertures while the face member of the ornamental attachment extends over at least a portion of the flaps.

In the preferred embodiment, the face member is an embroidered patch having an ornamental design thereon. However, a second embodiment provides an ornamental element removably secured to the face member by adhesive.

The invention will be fully understood when reference is made to the following detailed description taken in conjunction with the accompanying drawing.

DETAILED DESCRIPTION OF THE DRAWINGS

Figure 1:
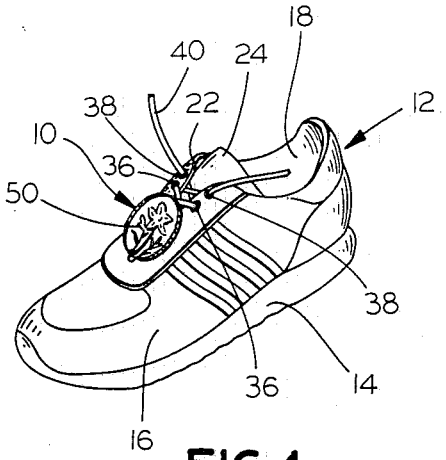
FIG. 1 is a perspective view of an athletic shoe having mounted thereon an ornamental attachment embodying the present invention.

Turning first to FIG. 1 of the drawings, therein illustrated an ornamental attachment embodying the present invention and generally designated by the numeral 10 as mounted on an athletic shoe generally designated by the numeral 12. The shoe 12 is of conventional construction having an elongated sole 14 made from rubber or other high friction material with a main body portion or upper 16 secured thereto and generally constructed from leather or fabric material to define an enclosure or interior 18. The upper 16 has a pair of opposed flaps 20 defining a throat or opening 22 between the opposed edges 26 and 28 thereof, and a tongue or flap 24 attached at its lower end and underlying the flaps 20 and the throat 22 in a conventional manner.

Figure 2:
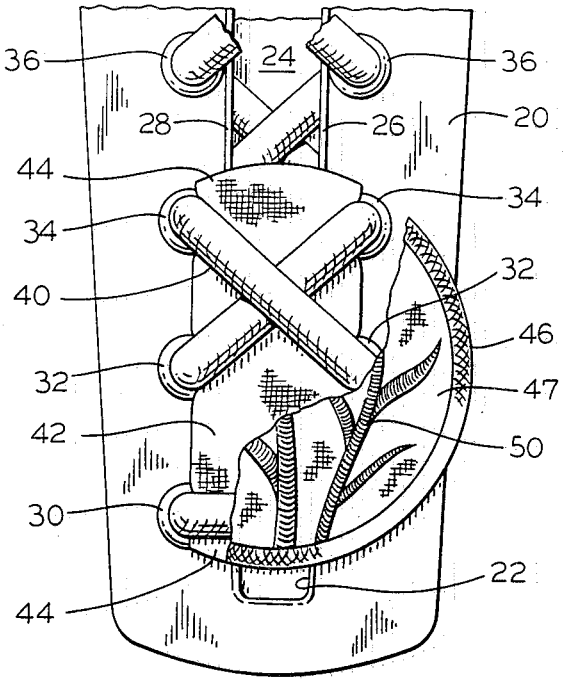
FIG. 2 is an enlarged fragmentary plan view of the shoe assembly of FIG. 1 with portions of the ornamental attachment broken away to illustrate the underlying shoelace and securing structure.
Figure 3:
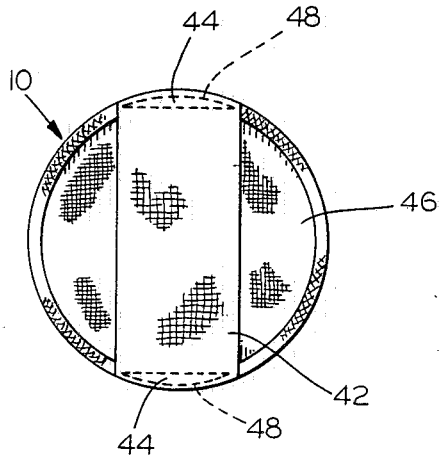
FIG. 3 is a rear view of the ornamental attachment of the present invention.
Figure 4:
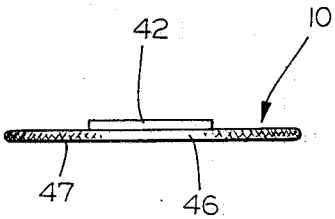
FIG. 4 is a top edge view thereof.

As best seen in FIG. 2, the shoe 12 has a multiplicity of pairs of opposed eyelets or apertures 30–38 in the upper 16 which are reinforced by metallic grommets and are spaced uniformly along opposed edges 26 and 28 of the flaps 20 adjacent the throat 22. A lace 40 extends through the eyelets 30–38 in the flaps 20 in an interlacing or crisscrossing manner. This arrangement allows the user to draw together the side edges 26 and 28 of the flaps 20 by pulling on the free ends of lace 40.

The ornamental attachment 10 includes a support member 42 constructed from a strip of flexible sheet material and extending longitudinally along the throat 22. It should be noted that the support member 42 is elongated and, in the illustrated shoe, is of a length greater than the distance between the lower pair of eyelets 30 and the third pair of eyelets 34 to allow the support member 42 to underlie the portions of the lace 40 which extend outwardly of the enclosure 18 between the lower three pairs of cooperating eyelets 30, 32 and 34. The support member 42 is relatively narrow so that it will lie generally within flat the transverse spacing between the apertures 30–38.

Figure 5:
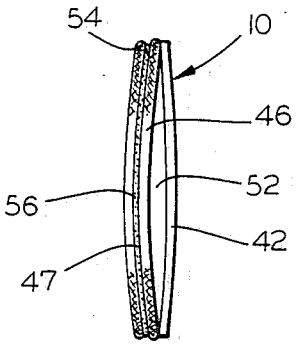
FIG. 5 is a side edge view of a second embodiment of the ornamental attachment of the present invention utilizing a removably affixed decalcomania.

The ends 44 of the support member are secured by stitches 48 to an ornamental display portion or face member 46 to define a passage 52 therebetween extending transversely of the throat 22 (seen best in FIGS. 2 and 5). The face member 46 has an upper display surface 47 and overlies the portions of lace 40 extending between the lower three pairs of opposed eyelets 30, 32 and 34. In the illustrated embodiment, the ornamental display portion 46 of the ornamental attachment 10 is an embroidered fabric patch providing an embroidered design 50.

Referring now to FIG. 5, illustrated therein is a second embodiment of the ornamental attachment 10 of the present invention. This embodiment has an ornamental member or decal 54 which is releasably fastened by means of adhesive 56 to the upper display surface 47 of the face member 46. The face member 46 is preferably made from a material, which, in cooperation with the adhesive 56 on the decal 54, permits removal of the adhesive 56 with the ornamental member 54 on thereby allowing its replacement by another ornamental member having a different design or color combination thereon.

In attaching the ornamental attachment 10 to the shoe 12, prior to the interlacing of the lace 40 through the pairs of cooperating eyelets 30–38, the user simply inserts the lace 40 through the passage 52 in the attachment 10. Thereafter, the free ends of the lace 40 are inserted through the lower pair of cooperating eyelets 30 and interlaced as shown in FIG. 2. The portions of the lace 40 extending between eyelets 32 and 34 are passed through the opening 52 in the ornamental attachment 10, thereby holding the ornamental display portion 46 flat against the lace 40. The portions of lace 40 which cross between eyelets 34 and 36 and thereinafter between eyelets 36 and 38 are disposed outwardly of the passage 52. As seen, at least the portion of the lace 40 extending from the uppermost pair of eyelets 38 are spaced upwardly from the ornamental attachment 10 and are exposed during use of the article of footwear to permit normal tying and untying of the athletic shoe 12.

The ornamental attachment may be used on any lace-type footwear including shoes, boots and slippers. The materials from which it is fabricated include fabric and plastic sheet material. When flexibility is not required for the face member, it may be fabricated from metal, glass or molded resins. The support member must be of a length to have at least two lace crossings within the passage and preferably at least three. The display member should be dimensioned and configured to conceal the support member, and is preferably of considerably greater dimension to provide a display surface which overlies the openings in the flaps through which the lace extends.

The ornamental display portion may be formed in a variety of shapes and sizes. It can be used to display cartoon characters, political choices during campaigns, vacation area insignias, sport team emblems, school or business emblems, club logos, and pom-poms with school colors for cheerleaders or marching bands. The design can be attached by any conventional method including embroidery printing or said like. Further, the ornamental display area can merely be a colored patch for fashion coordination.

Securing the face member to the support member can be accomplished in any conventional manner including stitching, adhesives, staples or releasable snap fasteners. When a separate decorative element is affixed to the display portion, it may be secured thereto by adhesives, stitching, staples or hook and loop material fasteners.

It should be appreciated that the ornamental portion covers at least a portion of the lace and the lacing opening thereby inhibiting the influx of dirt, water and other foreign matter into the enclosure of the article of footwear.

Thus, it can be seen from the foregoing detailed specification and attached drawings that the ornamental attachment can be readily applied and interchanged without modification to the article of footwear by utilizing the existing laces. Further, the lace of the article of footwear can be tied and untied in a normal manner without interference from the ornamental attachment.

Having thus described the invention, I claim:

1. In combination with an article of footwear having an upper with a toe portion, opposed flaps having a multiplicity of pairs of cooperating apertures in opposed edges thereof, and a lace extending through said cooperating apertures, the pair of apertures adjacent said toe portion being designated the lowermost pair, an ornamental attachement engaged with said lace and overlying a portion of said article of footwear, said attachment including a face member overlying a portion of said lace adjacent said toe portion and a support member non-releaseably attached at its ends to said face member to define a passage between said ends extending generally transversely to the direction of said opposed flaps, said lace extending through said passage as said lace is criss-crossed between at least two pairs of said apertures to secure said attachment on said article of footwear, at least the portion of the lace extending from the uppermost pair of apertures being spaced upwardly from said ornamental attachment and being exposed during use of the article of footwear.

2. The combination in accordance with claim 1 wherein said support member is of lesser width than the transverse spacing between said opposed apertures.

3. The combination in accordance with claim 1 wherein said face member of said ornamental attachment extends over at least a portion of said flaps.

4. The combination in accordance with claim 1 wherein said face member is an embroidered patch having an ornamental design thereon.

5. The combination in accordance with claim 1 wherein said ornamental attachment further includes an ornamental element removably secured to said face member.

6. The combination in accordance with claim 1 wherein said ornamental element is attached to said face member by adhesive and has an ornamental design thereon.

7. The combination in accordance with claim 1 wherein said cooperating apertures of said article of footwear are at least four pairs of apertures spaced uniformly along said opposed flaps and through which said lace extends, at least said portions of said lace extending between said upper pair of said at least four apertures and said next adjacent pair being disposed outwardly of said passage.

8. The combination in accordance with claim 7 wherein said face member extends over the lower three pairs of said at least four pairs of opposed apertures in said opposed flaps.

9. The combination in accordance with claim 7 wherein said lace extends between the lowermost pair of apertures and through said passage, then said lace crisscrosses within the interior of said article of footwear to the adjacent pair of apertures outwardly of said passage, and thereinafter said lace crisscrosses to said next adjacent pair of apertures and through said passage to secure said ornamental attachment to said article of footwear.

* * * * *